US009757783B2

(12) United States Patent
Guernsey et al.

(10) Patent No.: US 9,757,783 B2
(45) Date of Patent: Sep. 12, 2017

(54) METHOD AND MACHINE FOR BENDING METAL

(71) Applicant: Accurpress America Inc., Rapid City, SD (US)

(72) Inventors: Allen Guernsey, Rapid City, SD (US); Stephen Hilton, Rapid City, SD (US)

(73) Assignee: ACCURPRESS AMERICA INC., Rapid City, SD (US)

( * ) Notice: Subject to any disclaimer, the term of this patent is extended or adjusted under 35 U.S.C. 154(b) by 5 days.

(21) Appl. No.: 15/075,075

(22) Filed: Mar. 18, 2016

(65) Prior Publication Data

US 2016/0271670 A1 Sep. 22, 2016

Related U.S. Application Data

(60) Provisional application No. 62/177,614, filed on Mar. 19, 2015.

(51) Int. Cl.
*B21D 5/02* (2006.01)

(52) U.S. Cl.
CPC ..... *B21D 5/0209* (2013.01); *B21D 5/02* (2013.01)

(58) Field of Classification Search
CPC ..... B21D 5/02; B21D 5/0209; B21D 5/0254; B21D 5/0263; B21D 37/04; B21D 37/02; B21D 37/06
See application file for complete search history.

(56) References Cited

U.S. PATENT DOCUMENTS 2,426,446 A * 8/1947 Funk ..... B21D 5/02 72/31.11
3,214,955 A * 11/1965 Voth ..... B21D 5/02 72/389.4
2010/0251797 A1 10/2010 Sperrer

FOREIGN PATENT DOCUMENTS

| | | | |
|---|---|---|---|
| JP | 08-007931 Y2 | | 3/1996 |
| JP | 2001-129612 A | | 5/2001 |
| JP | 2002-239631 A | | 8/2002 |
| JP | 2008-087018 A | | 4/2008 |
| JP | 2008087018 A | * | 4/2008 |

OTHER PUBLICATIONS

International Search Report mailed May 26, 2016 issued in PCT/US2016/023300.
Written Opinion mailed May 26, 2016 issued in PCT/US2016/023300.

* cited by examiner

*Primary Examiner* — Debra Sullivan
(74) *Attorney, Agent, or Firm* — Gordon Rees Scully Mansukhani LLP

(57) ABSTRACT

A method of bending a sheet of metal using a press brake includes pivoting die holders during the bending operation so bends can be made in opposite directions without having to turn over or flip over the sheet of metal. In the method a first die holder is driven downward toward a second die to thereby create a bend in the metal sheet when the first and second dies come together. The first die holder and the first die are then retracted away from a second die holder and the second die. The die holders are moved, preferably rotated, to a second position in which the first die holder is located over the second die holder. Then the second die holder is driven downward toward the first die to thereby create a second bend in the metal sheet when the first and second dies come together.

18 Claims, 4 Drawing Sheets

METHOD AND MACHINE FOR BENDING METAL

CROSS REFERENCE TO RELATED APPLICATIONS

This application claims priority to and the benefit of U.S. Provisional Patent Application No. 62/177,614 filed on Mar. 19, 2015. The foregoing provisional application is incorporated by reference herein in its entirety.

BACKGROUND

The application relates generally to press brakes and, in particular, a press brake that includes a structure and mechanism for rotating the head for pressing metal in opposite directions.

A press brake machine or device is used as a tool to make precise bends in metal parts. Generally, a sheet of metal is placed within the machine and positioned precisely using a gauge. A die, which often has the shape of a "V," is placed against the metal sheet at the point where a bend is required. A punch is pressed into the metal sheet, which in turn is pressed into the die causing the sheet to bend. Frequently, the press brake machine is configured so that die and the punch are long enough to contact the entire length or width of the sheet.

A press brake machine may include various movable gauges which are positioned such that they act to insure that a piece of material to be bent is positioned properly relative to the die. In conventional press brake machines, the punch is located above the metal sheet and the die is located under the sheet. In general, most bends have a ninety degree turn, but a press brake may also be used to form bends at various angles. However, a conventional press brake machine, may only bend the metal sheet in one direction. In a conventional press brake, the punch pushes metal into the die and the metal sheet begins to form a "V" shape with he lowest point of the "V" being beneath the punch in the die.

In many instances, a piece of sheet metal must be bent in both directions in order to create the desired shape. The inability of a conventional press brake machine to bend metal in opposing directions creates inefficiencies and adds cost to the metal forming process. When a conventional press brake machine is used for creating bends in two different directions, the sheet of metal must be removed from the device and turned over such that a bend may be made in the other direction. As described herein the present application discloses a press brake device that overcomes the limitations and deficiencies described above.

SUMMARY

According to a disclosed embodiment, a press brake machine is provided that includes a punch and a die located in a rotating module. Because the module can rotate, a sheet of metal may be bent in both directions by bending the metal in one direction and then rotating the module such that the metal may be bent in the other direction.

According to an exemplary embodiment disclosed herein, a press brake for bending a metal sheet is provided. The press brake includes a movable ram and a support beam. The the ram and the support beam are connected to a supporting frame. A first tool holder is configured to hold a punch and a second tool holder configured to hold a die. The punch and the die are separated by a gap and the press brake is configured to receive the metal sheet in the gap. The ram is configured to be driven and force one of the tool holders toward the other tool holder to thereby close the gap between the punch and the die and form a bend in the metal sheet. The tool holders are configured to be moved simultaneously between two positions. In the first position, the first tool holder is positioned adjacent to the ram and the second tool holder is positioned adjacent to the support beam. In the second position, the second tool holder is positioned adjacent to the ram and the first tool holder is positioned adjacent to the support beam.

According to another exemplary embodiment, a machine for being sheet metal is disclosed herein. The machine includes a movable ram connected to a stationary frame. The machine includes a first tool holder carrying an elongated punch and a second tool holder carrying an elongated die. The punch is configured to cooperate with the die in performing a bending operation on an metal sheet positioned between the punch and die. The tool holders are connected to a pivoting support member. The machine includes a motor for driving the support member to pivot between two positions. In the first position, the first tool holder is positioned to move with the movable ram. In the second position, the second tool holder is positioned to move with the movable ram.

A method for bending metal is also disclosed herein. The method includes the step of placing the metal sheet under a first die mounted on a first die holder and over a second die mounted on a second die holder. The first die holder is driven downward toward the second die to thereby create a bend in the metal sheet when the first and second dies come together. The first die holder and the first die are retracted away from the second die holder and second die. The method includes moving the die holders so that the first die holder is located over the second die holder. The second die holder is driven downward toward the first die to thereby create a second bend in the metal sheet when the first and second dies come together.

It is to be understood that both the foregoing general description and the following detailed description are exemplary and explanatory only, and are not restrictive of the invention as claimed.

BRIEF DESCRIPTION OF THE DRAWINGS

Features, aspects, and advantages of the present invention will become apparent from the following description, appended claims, and the accompanying exemplary embodiments shown in the drawings, which are briefly described below.

DETAILED DESCRIPTION

Various features of the present invention will be described with reference to the drawings. Like numbers are used throughout the drawings to refer to the same or similar parts and in each of the embodiments of the invention hereafter described.

The press brake disclosed herein is used to bend or otherwise deform sheet-like work pieces, such as sheet metal work pieces. The press brake has an upper beam and a lower beam, at least one of which is movable toward and away from the other. Preferably, the upper beam is movable vertically while the lower beam is fixed in a stationary position. As an example, a male forming punch and a female forming die may be mounted respectively on the upper and lower beams of a press brake.

The punch has a downwardly-oriented, work piece-deforming surface (or "tip"). The configuration of this surface is dictated by the shape into which it is desired to deform a work piece. The die has a recess, bounded by one or more work piece-deforming surfaces, that is aligned with the tip of the punch. The configuration of this recess corresponds to the configuration of the punch's tip. Thus, when the beams are brought together, a work piece between them is pressed by the punch into the die to give the work piece a desired deformation (e.g., a desired bend).

In the disclosed machine, the tools (e.g., punch and die) are attached to tool holders that form a head or module. The head can be oriented in two different positions. In a first position, the punch pushes metal downward into the die and bends the ends upward. The head may then be rotated 180 degrees. In this second position, the die is driven downward onto the punch, which pushes the metal sheet upward into the die and forces ends of the sheet downward. Thus, a sheet may be bent in either direction without having to remove the sheet from the machine and turn the sheet over. Thus, the innovative press break disclosed herein provides a simple and efficient method of bending a sheet of metal in either direction. The machine provides this ability to bend a sheet of metal in either direction while, at the same time, being a simple, elegant and reliable design that is reliable and easy to use and maintain.

Figure 1:
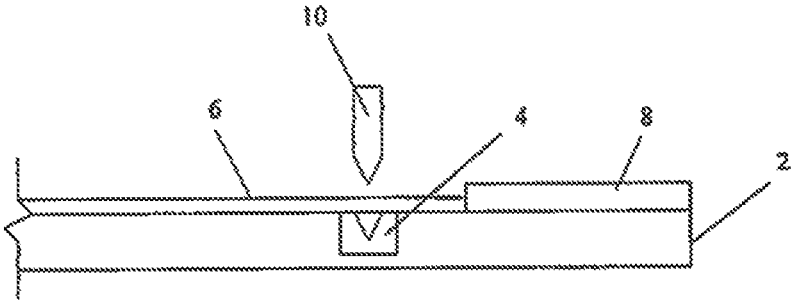
FIG. 1 is a side view of a portion of a press brake machine with a sheet of metal positioned in the machine.
Figure 2:
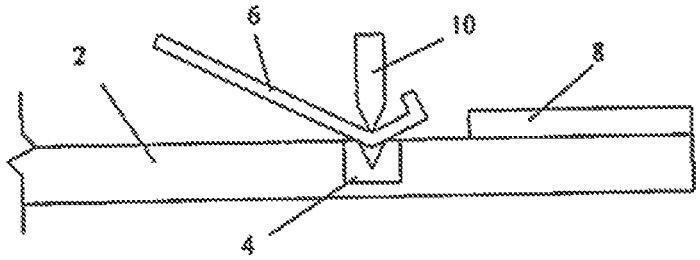
FIG. 2 is a side view of the press brake machine of FIG. 1 with a sheet in the process of being bent.

The bending portion of a press brake machine is shown in FIG. 1. A lower bed or beam 2 acts as a work surface and holds a die 4 in place. The metal sheet 6 to be bent is placed on the plate 2. Ordinarily, a gauge 8 is used to properly position the metal sheet 6 within the machine to ensure that the bends occur at the appropriate part of the sheet and extend in the appropriate direction. During the bending operation, a punch 10 is pushed downward which forces the metal sheet 6 down into the die 4. The punch 10 and die 4 cooperate to cause the metal sheet 6 to bend as shown in FIG. 2. That is, the portion of the metal sheet 6 beneath the punch 10 moves downward and the ends of the sheet move upward. The press brake can be used by the operator to bend the metal sheet 6, for example, at an angle of 90 degrees.

FIG. 2 shows a metal sheet after a 90 degree bend has been made in the sheet and a second bend has been started. As may be seen from this figure, it is possible to make several bends in a piece of sheet metal such as metal sheet 6, where all of the bends are in the same general direction.

Figure 3:
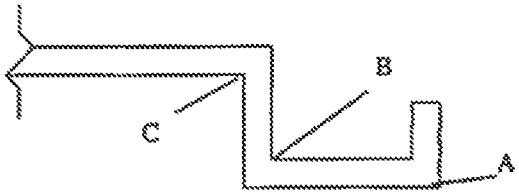
FIG. 3 is a side view of a metal sheet that has been bent three times.

FIG. 3 shows a sheet of metal that has been bent three times. The bends made at the corners A and B are in the same direction. However, the bend made at the corner C is in the other direction. Until development of the press brake disclosed herein, bend at corner C extending along the full length of a large sheet of metal could not be made without totally removing the sheet of metal from the machine and turning or flipping the sheet over.

Figure 4:
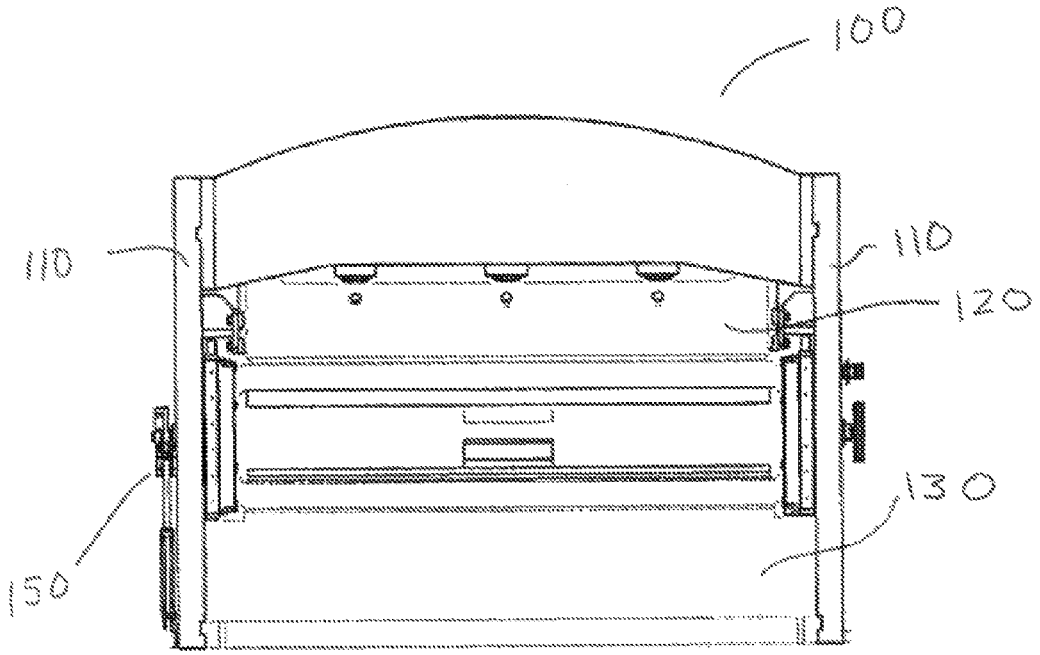
FIG. 4 is a front view of press brake machine with movable tools.

FIG. 4 discloses a press brake machine 100 that is capable of bending a metal sheet in two different directions without the metal sheet having to be flipped or turned over. The machine 100 includes a support frame with two vertical beams or columns 110. The machine also includes rearward extending leg braces 140 to provide further support for the machine. When a sheet is in place and being worked on the press brake may include additional structural support (e.g., a table) for the sheet. The machine may also include a guide positioned adjacent the plate to hold the plate in the proper horizontal position for bending. The machine 100 includes a movable upper beam or ram 120 that extends between the vertical columns 110. A lower support bed or beam extends between the columns at a position below where the sheet passes through the machine 100. The ram 120 is configured to be driven downward by one or more hydraulic actuators. Thus, the vertical position of the ram 120 relative to supporting vertical columns 110 can change while the tool is being worked. The lower bed or beam 130 is stationary.

Figure 5:
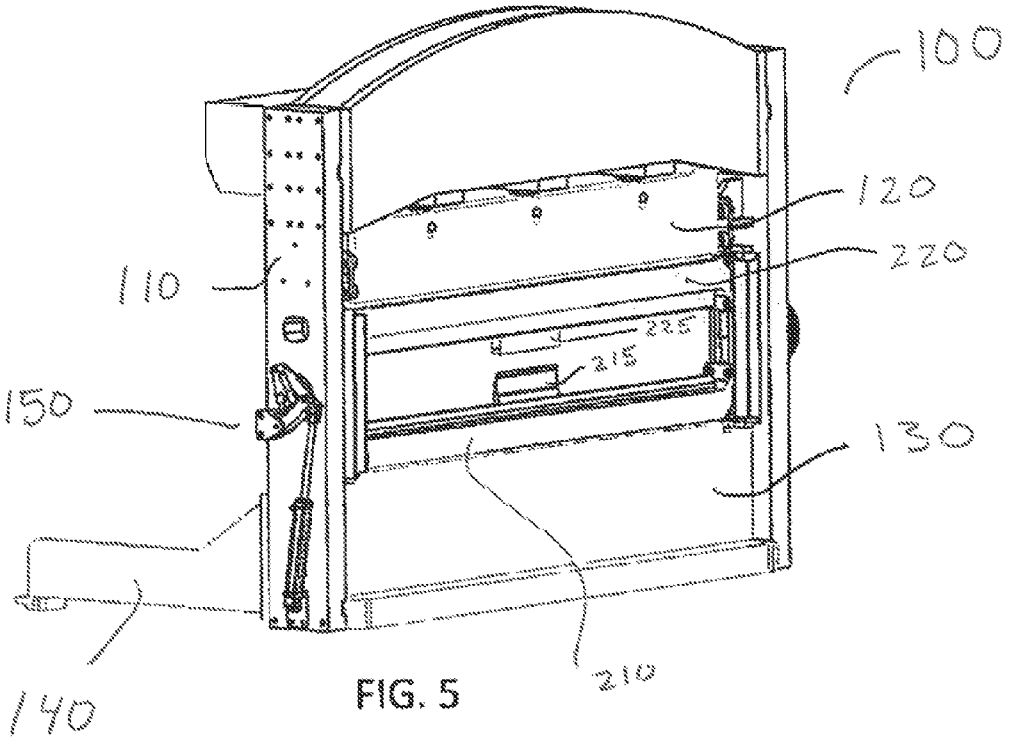
FIG. 5 is a front and right side view of the press brake machine of FIG. 4.
Figure 6:
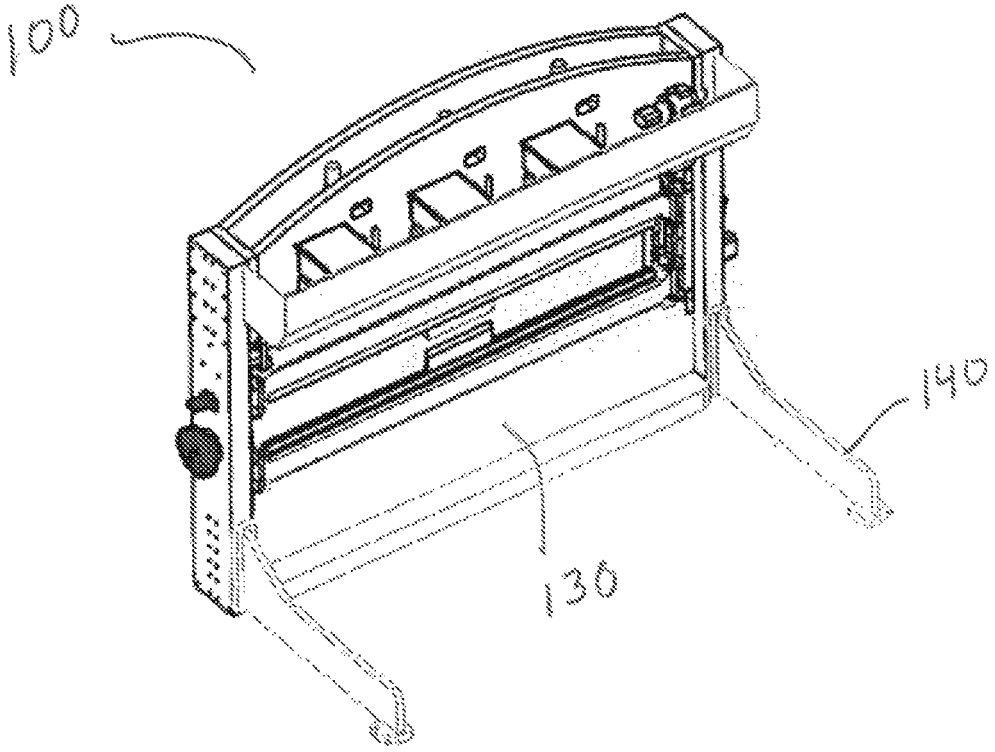
FIG. 6 is a rear and left side view of the press brake machine of FIG. 4.

In FIGS. 4-6, the press brake machine 100 is shown in a second position in which a die type tool 225 is located above a punch type tool 215. These tools are removable and replaceable and may be selected based on the type of sheet and bending operation required. The tools are held in tool holders 210, 220 in a conventional fashion. The first tool holder 210 is shown adjacent to the lower beam or support bed 130. The second tool holder 220 is shown in FIGS. 4-6 in a position adjacent to the vertically moving ram 120. The tool holders 210, 220 extend between end supports or support members 230. Thus, the tool holders 210, 220, tools 215, 225 and support members 230 form a movable module or head.

Each of the tool holders 210, 210 is configured to be mated with the adjacent beam (i.e., either the upper beam or ram 120 or the lower beam or support bed 130) using an engagement mechanism. The mated connection or engagement ensures that the tools will not move laterally relative to the cross beams while the metal sheet is being worked. Also, the upper tool holder (i.e., the tool holder 220 in FIGS. 4-6) is configured to be moved downwardly with the moving ram 120. Thus, the upper tool is driven down by the ram pushing the tool holder. One example of the mating connections between the beams and the tool holders is a tongue and groove type connection. In this arrangement, the cross beams include a protruding tapered ridge that mates with a matching tapered groove in the tool holders. Each tool holder must be capable of mating witch each beam so the mating connections are the same in both beams and both tool holders.

Figure 7:
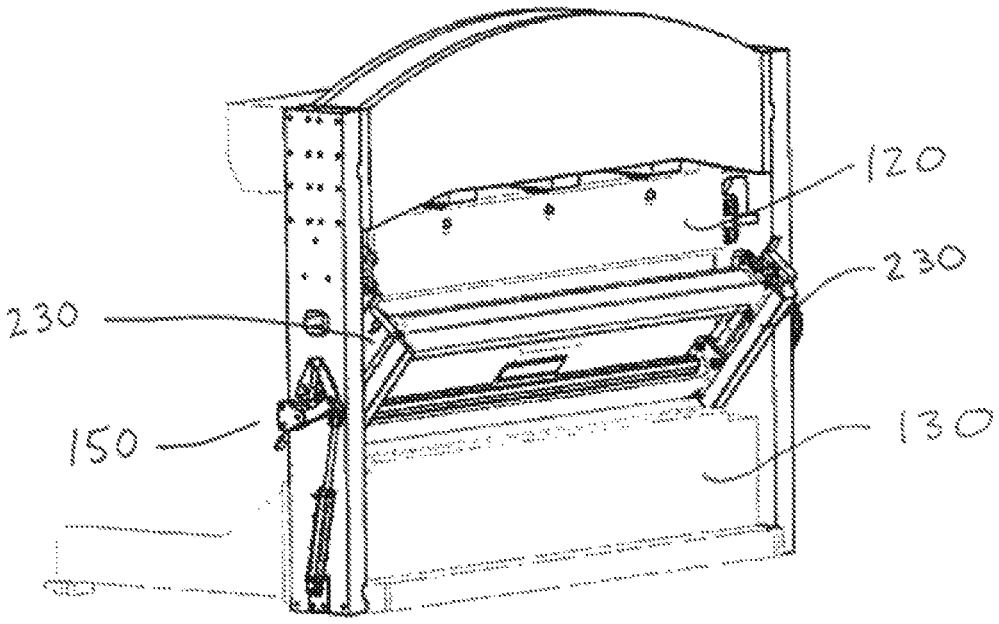
FIG. 7 is a front and right side view of the press brake machine of FIG. 4 while the tools are being pivoted or rotated.

FIG. 7 shows the press brake machine while the head is being rotated or pivoted from a first position to a second position. The support members 230 may be pivotally connected to the vertical support columns 110 by a rod or bar. The bar or rod extends essentially along the pivot axis for the head. At one end of the head, a motor 150 is connected to one of the support columns 110. The motor 150 drives the pivoting or rotation of the head to a new position. As shown in FIG. 7, the motor 150 may be a hydraulic actuator that includes a piston cylinder arrangement with mechanical linkage and motion translator that changes the longitudinal motion of the piston to a rotational motion of the rod and head. Any other conventional motor may be used, such as an electrical motor, for example.

In order for the tool holders 210, 220 to be rotated and separated from the cross beams 120, 130 the mating connection between the tool holders 210, 220 must be separated. The tool holders 210, 220 are configured to each be moved inwardly (i.e., toward the other tool holder) to allow the mating connection to the adjacent beam to be broken. The vertical or lateral motion of the tool holder may be driven by any suitable mechanism for causing linear movement. For example, a hydraulic actuator may be used such as, for example, nitrogen gas piston/cylinder mechanism. An electric type linear motor may also be used. Preferably, the linear motor or actuator is mounted in one or both of the support members 230. When rotation of the head is required, the tool holders essentially slide along the support members 203 and move toward each other and any connection to the adjacent beam is removed. Then the head or module may be rotated and pivoted by operating the motor 150 to move the tool holders to a second position. Movement of the tool holders from the first to the second position is essentially a 180 degree rotation of the head or module. Once the tool holders are in the desired position, each tool holder may be driven away from the other tool holder to form an effective mating connection with the adjacent beam. Although not shown, the system typically would include a mechanism for moving the sheet out of position while the module is rotated. Although, unlike conventional machines, there is no need to flip or turn the sheet. Only a simple lateral translation of the sheet is required.

Figure 8:
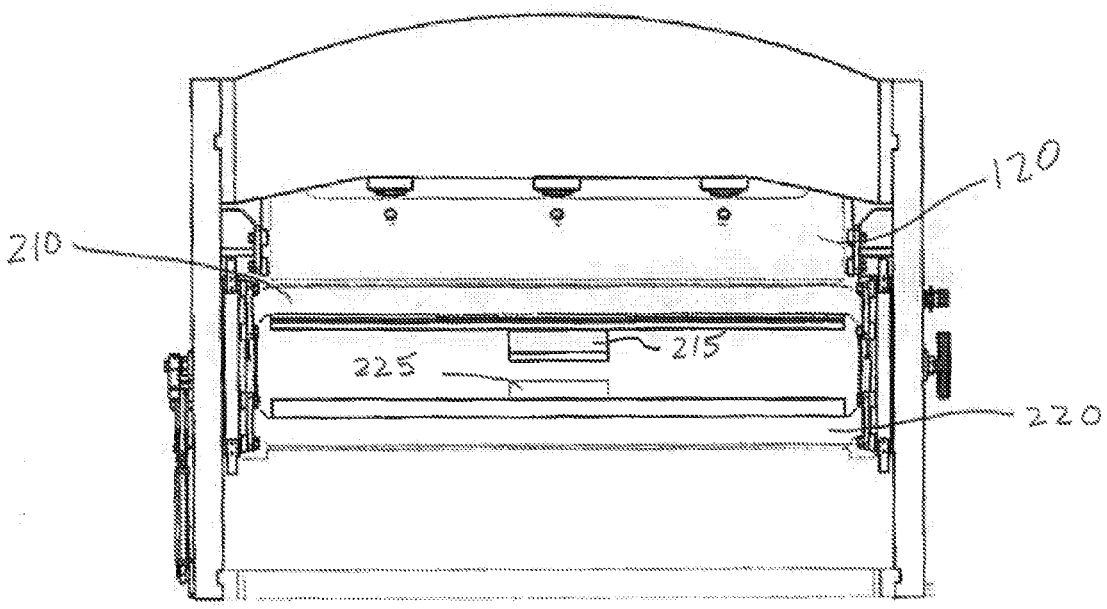
FIG. 8 is a front view of the press brake machine of FIG. 4 after the rotation of the tools is complete.

FIG. 8 shows the press brake machine after the motion shown in FIG. 7 is complete. In FIG. 8, the punch type tool 215 is positioned over the die type tool 225 and a gap exists between the tools to allow for a metal sheet to be inserted between the tools. When bending of a sheet is desired the ram 120 forces the tool holder 210 and punch 215 downwardly toward the die 225 to cause the metal sheet to bend. The die 225 and tool holder 220 are stationary during the bending operation. After the bending is complete, the ram 120 is retracted by the ram driving system (e.g., hydraulic actuator(s)). The upper tool holder also retracts (i.e., follows the ram back to a non-working position) due to the operation of the tool holder linear driving system mounted in the support member.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to any precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "fore," "aft," "inboard," "outboard," etc.) are merely used to describe the orientation of various elements in the figures. It should be noted that the orientation of various elements may differ according to other exemplary embodiments, and that such variations are intended to be encompassed by the present disclosure.

It is important to note that the construction and arrangement of the press brake shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A press brake for bending a metal sheet comprising:

a movable ram and a support beam, wherein the ram and the support beam are connected to a supporting frame;

a first tool holder configured to hold a punch;

a second tool holder configured to hold a die;

wherein the punch and the die are separated by a gap and wherein the press brake is configured to receive the metal sheet in the gap; and wherein the ram is configured to be driven and force one of the tool holders toward the other tool holder to thereby close the gap between the punch and the die; and wherein the tool holders are configured to be rotated simultaneously between two positions, wherein in the first position the first tool holder is positioned adjacent to the ram and the second tool holder is positioned adjacent to the support beam and wherein in the second position the second tool holder is positioned adjacent to the ram and the first tool holder is positioned adjacent to the support beam; and wherein the axis of rotation of the tool holders is parallel to a bend formed in the metal sheet by the punch and the die.

2. The press brake of claim 1, further comprising a pair of end supports for the tool holders, wherein each of the tool holders extends between and is connected to both end supports.

3. The press brake of claim 2, wherein each of the tool holders is configured to be slideable relative to the end supports so that each tool holder can be moved separately to close the gap when driven by the ram.

4. The press brake of claim 3, wherein each of the end supports is pivotally mounted to the supporting frame.

5. The press brake of claim 4, further comprising a motor mounted to the support frame for forcing an end support to pivot in order to move the tool holders from the first position to the second position and vice versa.

6. The press brake of claim 5, wherein the motor comprises a hydraulic motor.

7. The press brake of claim 5, wherein the motor comprises an electric motor.

8. A machine for bending a metal sheet comprising:

a movable ram connected to a stationary frame;

a first tool holder carrying an elongated punch and a second tool holder carrying an elongated die, wherein the punch is configured to cooperate with the die in performing a bending operation on an metal sheet positioned between the punch and die;

wherein the tool holders are connected to a first pivoting support member and a second pivoting support member wherein each of the support members is connected to an end of each of the tool holders; and a motor for driving the support members to pivot between two positions, wherein in the first position the first tool holder is positioned to move with the movable ram and in the second position the second tool holder is positioned to move with the movable ram.

9. The machine of claim 8, further comprising a support bed connected to the frame and wherein the machine is configured so that during the bending operation one of the tool holders is positioned adjacent to the support bed.

10. The machine of claim 8, wherein each of the tool holders is movable relative to each of the support members.

11. The machine of claim 8, wherein the movable ram is configured to be driven and thereby force one of the tool holders toward the other tool holder in order to perform the bending operation.

12. The machine of claim 11, further comprising an engagement mechanism for engaging each of the tool members with the movable ram so that when the ram is moving there is no relative movement between the movable ram and the tool holder located adjacent to the movable ram.

13. The machine of claim 12, wherein the engaging connection comprises a tongue and groove connection.

14. The machine of claim 8, wherein the motor comprises a hydraulic piston and cylinder arrangement.

15. A method of bending a sheet of metal comprising the steps of:

placing the metal sheet under a first die mounted on a first die holder and over a second die mounted on a second die holder;

driving the first die holder downward toward the second die to thereby create a bend in the metal sheet when the first and second dies come together;

retracting the first die holder and the first die away from the second die holder and second die;

pivoting the die holders around a pivoting axis parallel to the bend, wherein the die holders pivot from a first position wherein the first die holder is located over the second die holder to a second position wherein the first die holder is located under the second die holder; and driving the second die holder downward toward the first die to thereby create a second bend in the metal sheet when the first and second dies come together.

16. The method of claim 15, further comprising the steps of:

withdrawing the metal sheet from between the die holders after the first die holder is retracted away from the second die; and inserting the metal sheet to a position under the second die and over the first die after the step of pivoting the die holders;

wherein the metal sheet is not turned over between the withdrawing and inserting steps thereby ensuring that an upward facing side of the sheet faces the first die when the first die holder is driven downward and the same upward facing side of the sheet faces the second die when the second die holder is driven downward.

17. The method of claim 15, further comprising the step of moving each of the die holders toward each other prior to the pivoting step to disengage the die holders from adjacent beams.

18. The method of claim 15, wherein during the step of creating the first bend in the metal sheet the first die contacts an upward facing side of the metal sheet and during the step of creating a second bend in the metal sheet the second die contacts the same upward facing side of the metal sheet.

* * * * *